US012497218B1

(12) United States Patent
Huang et al.

(10) Patent No.: US 12,497,218 B1
(45) Date of Patent: Dec. 16, 2025

(54) STRAW CUP

(71) Applicant: Guangdong Musen Daily Products Co., Ltd., Yangjiang (CN)

(72) Inventors: Sihua Huang, Yangjiang (CN); Desheng Deng, Yangjiang (CN); Yong Lin, Yangjiang (CN); Yuan Yin, Yangjiang (CN)

( * ) Notice: Subject to any disclaimer, the term of this patent is extended or adjusted under 35 U.S.C. 154(b) by 2 days.

(21) Appl. No.: 18/811,653

(22) Filed: Aug. 21, 2024

(51) Int. Cl.
*B65D 47/06* (2006.01)
*A47G 19/22* (2006.01)
*B65D 25/28* (2006.01)

(52) U.S. Cl.
CPC ..... *B65D 47/06* (2013.01); *A47G 19/2272* (2013.01); *B65D 25/2802* (2013.01); *B65D 2543/00046* (2013.01)

(58) Field of Classification Search
CPC .... B65D 25/2802; B65D 25/28; B65D 47/06; B65D 47/061; B65D 47/063; B65D 47/065; B65D 47/066; B65D 47/068; A47G 19/2272; A47G 19/2266
See application file for complete search history.

(56) References Cited

U.S. PATENT DOCUMENTS

| | | | | |
|---|---|---|---|---|
| 10,974,881 | B1 * | 4/2021 | Ashton | A24F 13/12 |
| 10,988,389 | B1 * | 4/2021 | Guduru | B65D 47/32 |
| 2006/0226110 | A1 * | 10/2006 | Choi | B65D 47/065 220/203.04 |
| 2010/0181329 | A1 * | 7/2010 | Davies | B65D 47/065 220/707 |
| 2012/0187075 | A1 * | 7/2012 | El-Saden | B65D 51/242 215/389 |
| 2014/0048511 | A1 * | 2/2014 | El-Saden | A47G 19/2266 215/389 |

* cited by examiner

*Primary Examiner* — Javier A Pagan
(74) *Attorney, Agent, or Firm* — Shen Huang

(57) ABSTRACT

The disclosure discloses a straw cup, comprising a cup body and a cup lid covering the cup body, wherein the cup lid comprises: a cup lid body, comprising a lid structure and a handle structure connected to the lid structure; a sippy spout assembly, rotatably connected to the lid structure and having a closed state of being folded relative to the lid structure and an open state of being unfolded relative to the lid structure, the sippy spout assembly being provided with a first locking portion; a transmission structure, provided with a second locking portion arranged corresponding to the first locking portion, the sippy spout assembly being kept in the closed state by making the first locking portion fitted with the second locking portion, and the sippy spout assembly being allowed to switch to the open state by unfitting the first locking portion and the second locking portion.

20 Claims, 11 Drawing Sheets

STRAW CUP

FIELD OF TECHNOLOGY

The disclosure relates to the field of cups, in particular to a straw cup.

BACKGROUND

A straw cup is a container used for drinking water, coffee, milk tea, and other beverages. The commonly seen straw cups on the market now have a suction nozzle. Most of them, as disclosed in a utility model patent with a suction nozzle cup lid (publication number: CN214803963U), have a suction nozzle that can be rotated and connected to the cup lid. The side of the suction nozzle is fixed with a locking block, and the cup lid is fixed with a locking groove. When the suction nozzle is stored relative to the cup lid, it is locked by the locking block and the locking groove. When people want to drink, they need to hold the cup with one hand and move the suction nozzle with the other hand to detach the locking block from the locking groove, allowing the suction nozzle to flip to the unfolded state. The operation is not complicated. Convenient, not suitable for drinking while driving.

SUMMARY

In view of the defects in the prior art, the disclosure provides a straw cup, comprising a cup body and a cup lid covering the cup body, wherein the cup lid comprises: a cup lid body, comprising a lid structure and a handle structure connected to the lid structure; a sippy spout assembly, rotatably connected to the lid structure and having a closed state of being folded relative to the lid structure and an open state of being unfolded relative to the lid structure, the sippy spout assembly being provided with a first locking portion; a transmission structure, provided with a second locking portion arranged corresponding to the first locking portion, the sippy spout assembly being kept in the closed state by making the first locking portion fitted with the second locking portion, and the sippy spout assembly being allowed to switch to the open state by unfitting the first locking portion and the second locking portion; and an operating structure, mounted on the handle structure, connected with the transmission structure in a transmission way, and capable of moving relative to the handle structure to drive the transmission structure to move until the second locking portion is away and unfitted from the first locking portion.

According to the straw cup provided by the disclosure, the sippy spout assembly is kept in the closed state of being folded relative to the lid structure by making the second locking portion on the transmission structure fitted with the first locking portion on the sippy spout assembly. The second locking portion moves relative to the sippy spout assembly along with the transmission structure. Before drinking, the operator only needs to drive the operating structure to move relative to the handle structure by hand so as to drive the transmission structure and the second locking portion arranged on the transmission structure to be away and unfitted with the first locking portion, so that the sippy spout assembly is allowed to switch to the open state, which is simple to operate and convenient to use. Moreover, compared with the unlocking structure of manually pulling the fixed locking block to slide over the fixed locking groove directly in the prior art, the disclosure undoes the fit by making the movably arranged second locking portion move away from the first locking portion, which greatly reduces the friction produced between the second locking portion and the first locking portion in the unlocking process, prolongs the service life of the first locking portion and the second locking portion and makes the straw cup more durable. In addition, the sippy spout assembly is rotatably connected to the lid structure, and the operating structure is mounted on the handle structure, so that the operator can hold the whole straw cup by grasping the handle structure and drive the operating structure to move relative to the handle structure while grasping the handle structure. In this way, while the operator holds the straw cup with one hand, the sippy spout assembly is allowed to switch to the open state. Thereby, the straw cup is simple and convenient to operate, and is especially convenient to use during driving, thereby having high practicability.

BRIEF DESCRIPTION OF THE DRAWINGS

The accompanying drawings described herein are intended to provide further understanding of the present invention and form a part of the present application. The illustrative embodiments of the present invention and their description are used to explain the present invention and do not constitute undue limitation of the present invention. In the attached figure.

DESCRIPTION OF THE EMBODIMENTS

Figure 1:
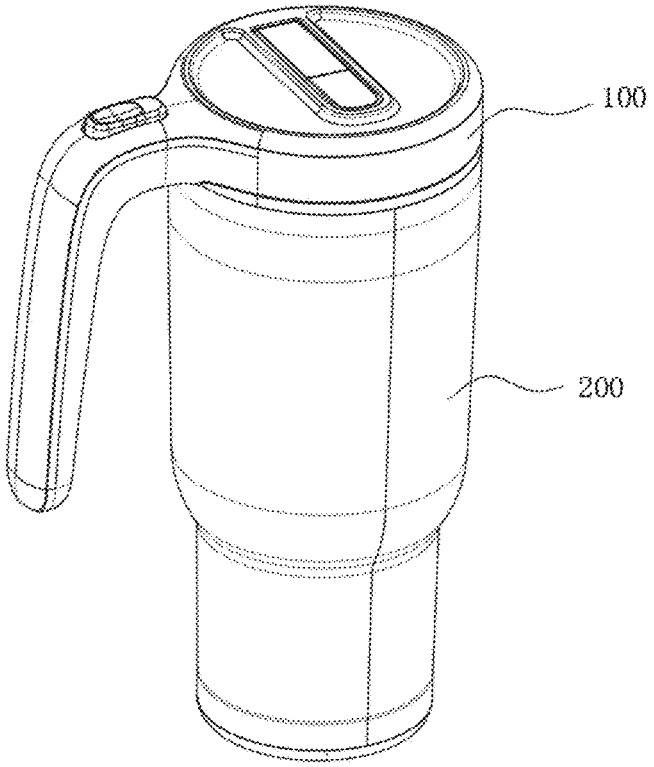
FIG. 1 is a schematic structural view I of a straw cup according to an example of the disclosure.

In order to clarify the purpose, technical solution, and advantages of the embodiments of the present invention, the following will provide a clear and complete description of the technical solution of the embodiments of the present invention in conjunction with the accompanying drawings.

As shown in FIG. 1 to FIG. 16, an example of the disclosure provides a straw cup, including a cup body 2000 and a cup lid 100 covering the cup body 200. The cup lid 100 includes a cup lid body 4, a sippy spout assembly 1, a transmission structure 2 and an operating structure 3. The cup lid body 4 includes a lid structure 41 and a handle structure 42 connected to the lid structure 41. The sippy spout assembly 1 is rotatably connected to the lid structure 41 and has a closed state of being folded relative to the lid structure 41 and an open state of being unfolded relative to the lid structure 41. The sippy spout assembly 1 is provided with a first locking portion 10. The transmission structure 2 is provided with a second locking portion 20 arranged corresponding to the first locking portion 10. The sippy spout assembly 1 is kept in the closed state by making the first locking portion 10 fitted with the second locking portion 20, and the sippy spout assembly 1 is allowed to switch to the open state by unfitting the first locking portion 10 and the second locking portion 20. The operating structure 3 is mounted on the handle structure 42, connected with the transmission structure 2 in a transmission way, and capable of moving relative to the handle structure 42 to drive the transmission structure 2 to move until the second locking portion 20 is away and unfitted from the first locking portion 10. According to the straw cup of this example, the sippy spout assembly 1 is kept in the closed state of being folded relative to the lid structure 41 by making the second locking portion 20 on the transmission structure 2 fitted with the first locking portion 10 on the sippy spout assembly 1. The second locking portion 20 moves relative to the sippy spout assembly 1 along with the transmission structure 2. Before drinking, the operator only needs to drive the operating structure 3 to move relative to the handle structure 42 by hand so as to drive the transmission structure 2 and the second locking portion 20 arranged on the transmission structure 2 to be away and unfitted with the first locking portion 10, so that the sippy spout assembly 1 is allowed to switch to the open state, which is simple to operate and convenient to use. Moreover, compared with the unlocking structure of manually pulling the fixed locking block to slide over the fixed locking groove directly in the prior art, the disclosure undoes the fit by making the movably arranged second locking portion 20 move away from the first locking portion 10, which greatly reduces the friction produced between the second locking portion 20 and the first locking portion 10 in the unlocking process, prolongs the service life of the first locking portion 10 and the second locking portion 20 and makes the straw cup more durable. In addition, the sippy spout assembly 1 is rotatably connected to the lid structure 41, and the operating structure 3 is mounted on the handle structure 42, so that the operator can hold the whole straw cup by grasping the handle structure 42 and drive the operating structure 3 to move relative to the handle structure 42 while grasping the handle structure 42. In this way, while the operator holds the straw cup with one hand, the sippy spout assembly 1 is allowed to switch to the open state. Thereby, the straw cup is simple and convenient to operate, and is especially convenient to use during driving, thereby having high practicability.

Figure 7:
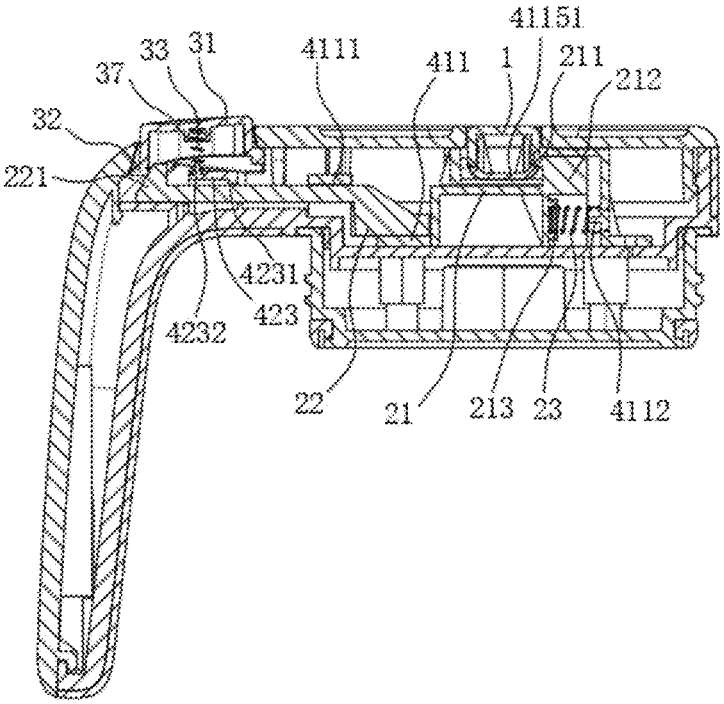
FIG. 7 is a schematic sectional structural view of the cup lid according to an example of the disclosure.
Figure 8:
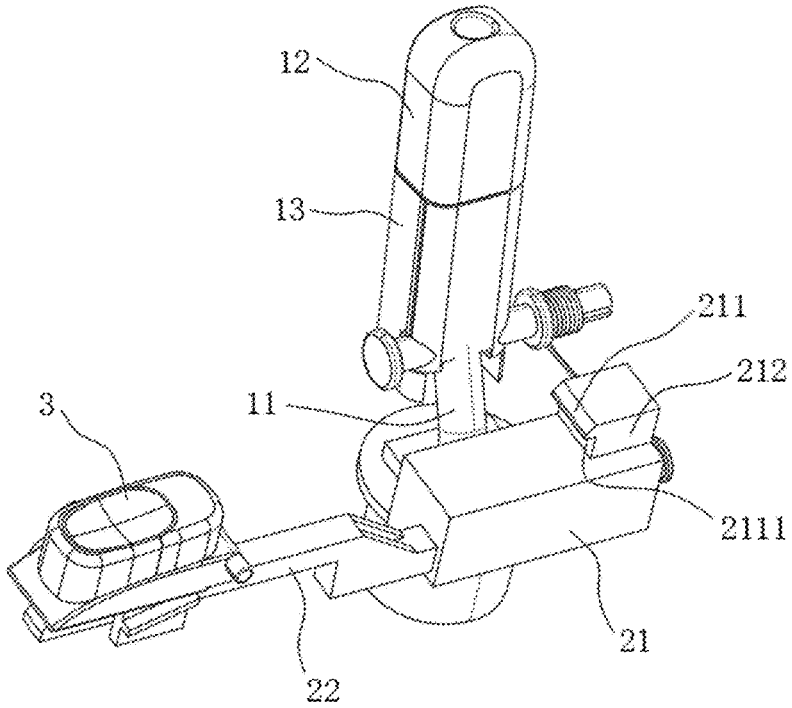
FIG. 8 is a schematic structural view I of a sippy spout assembly, a transmission structure and an operating structure according to an example of the disclosure.
Figure 9:
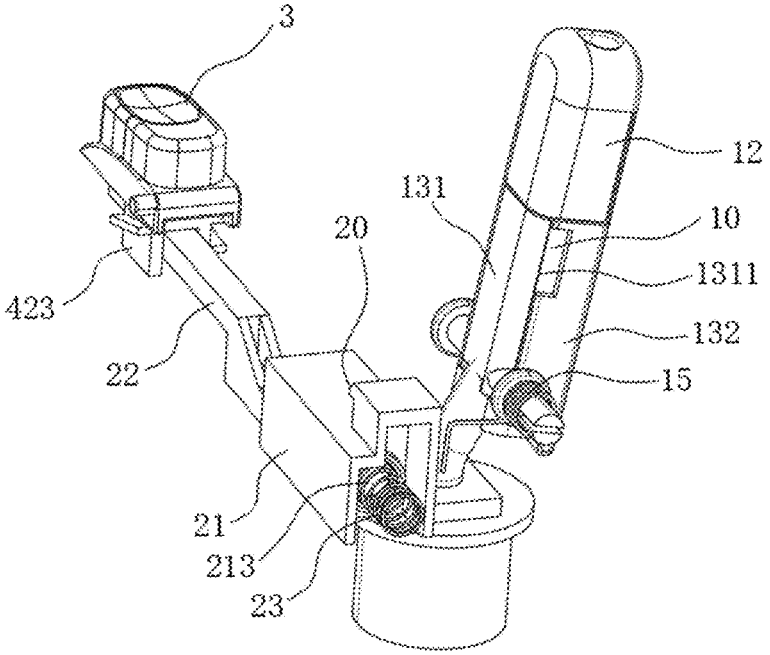
FIG. 9 is a schematic structural view II of the sippy spout assembly, the transmission structure and the operating structure according to an example of the disclosure.

As shown in FIG. 7 to FIG. 9, in some specific examples, the first locking portion 10 has a first locking surface 1311, and the second locking portion has a second locking surface 2111. The first locking portion 10 and the second locking portion 20 are fitted by making the second locking surface 2111 abut against an upper side of the first locking surface 1311 (for example, the first locking surface 1311 is arranged at a free end of the sippy spout assembly 1 or close to the free end of the sippy spout assembly 1, so that the sippy spout assembly 1 is prevented from rotating from the closed state to the open state by making the second locking surface 2111 block the upper side of the first locking surface 1311), and unfitted by making the second locking surface 2111 separated from the first locking surface 1311. In other examples, the first locking portion 10 and the second locking portion 20 may also fitted by making the second locking surface 2111 abut against a lower side of the first locking surface 1311. For example, the first locking surface 1311 is arranged at the rotatable connection position of the sippy spout assembly 1 or at an end of the rotatable connection position away from the free end of the sippy spout assembly 1, so that the sippy spout assembly 1 is prevented from rotating from the closed state to the open state by making the second locking surface 2111 block the lower side of the first locking surface 1311.

As shown in FIG. 9, in some specific examples, the first locking portion 10 is arranged at a side of the sippy spout assembly 1 away from the operating structure 3, and the transmission structure 2 moves between a first locked position close to the operating structure 3 and a first unlocked position close to the sippy spout assembly 1. When the transmission structure 2 is in the first locked position and the sippy spout assembly 1 is in the closed state, the second locking surface 2111 abuts against the upper side of the first locking surface 1311; and when the transmission structure 2 is in the first unlocked position and the sippy spout assembly 1 is in the open state, the second locking surface 2111 is separated from the first locking surface 1311 and arranged at a side of the first locking surface 1311 away from the operating structure 3. In this way, the transmission structure 2 is driven by the operating structure 3 to move from the first locked position toward the first unlocked position, and also drives the second locking surface 2111 to move toward a side of the first locking surface 1311 away from the operating structure 3 until it is separated from the first locking surface 1311 so as to unfit the second locking portion 20 and the first locking portion 10. In this example, the first locking portion 10 is arranged at the side of the sippy spout assembly 1 away from the operating structure 3, which makes the space for arranging the lid structure 41 and the sippy spout assembly 1 compact. In other examples, the first locking portion 10 may also be arranged at the lower side of the sippy spout assembly 1 so as to improve the reliability of connection between the sippy spout assembly 1 and the transmission structure 2.

As shown in FIG. 8, in some specific examples, the second locking portion 20 includes a second connecting block 212 arranged along a height direction and a second locking block 211 connected to an upper end of the second connecting block 212, and the second locking block 211 protrudes from a side of the second connecting block 212 close to the operating structure 3 so as to form the second locking surface 2111 at a bottom surface of the second locking block 211. It is defined that the sippy spout assembly 1 in the closed state is in the horizontal direction and the height direction is a direction perpendicular to the horizontal direction, which is beneficial to the stable connection between the first locking portion 10 and the second locking portion 20.

Figure 6:
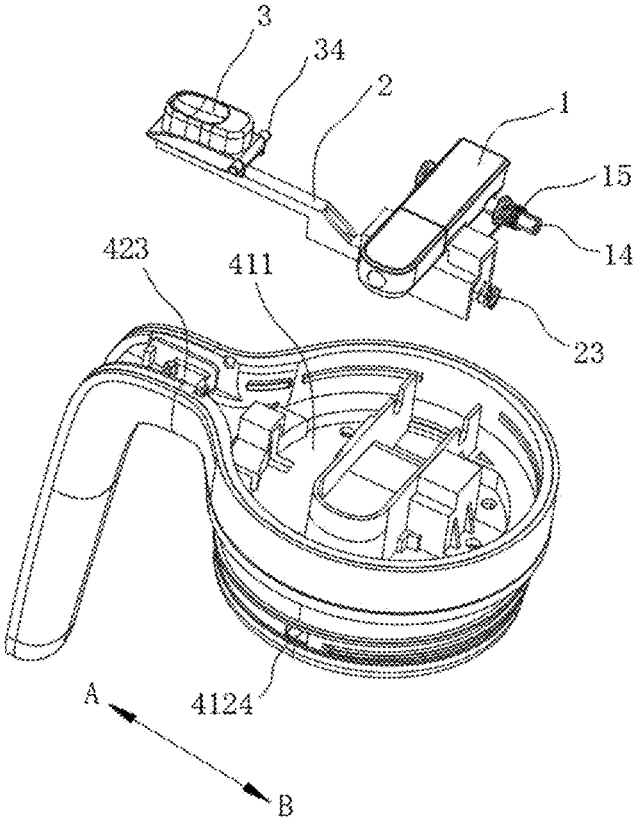
FIG. 6 is a schematic partial exploded structural view I of the cup lid according to an example of the disclosure.

As shown in FIG. 6, in some specific examples, an arrangement direction of the transmission structure 2 is perpendicular to an arrangement direction of the sippy spout assembly 1. The sippy spout assembly 1 includes a straw member 11, a sippy spout member 12 connected to a free end of the straw member 11, and a sippy spout sleeve 13 sleeved outside the straw member 11 and arranged close to an end of the sippy spout member 12 away from a free end of the sippy spout member 12. The first locking portion 10 is provided as a recess structure recessed from a side of the sippy spout sleeve 13 away from the operating structure 3. A bottom surface of the recess structure forms the first locking surface 1311. The second locking portion 20 extends its second locking block 211 into the recess structure to make the second locking surface 2111 abut against the upper side of the first locking surface 1211, so that the first locking portion 10 does not need to occupy additional arrangement space, which makes the arrangement space more compact. When the sippy spout assembly 1 is in the closed state, the sippy spout sleeve 13 drives the straw member 11 to be folded relative to the lid structure 41 so as to close the drinking channel.

In other examples, the first locking portion 10 may also be provided as a hook structure, which may be arranged at a side of the sippy spout sleeve 13 away from the operating structure 3 or at a bottom side of the sippy spout sleeve 13. In both cases, the first locking portion can be fastened with the second locking portion 20. The first locking portion 10 may also be provided as a protrusion structure protruding from a side of the sippy spout sleeve 13 away from the operating structure 3. In this case, the bottom surface of the protrusion structure can also form the first locking surface 1311. The sippy spout sleeve 13 may be sleeved outside the sippy spout member 12 and arranged at an end close to the sippy spout member 12 away from the free end of the sippy spout member 12, or may be sleeved outside both the sippy spout member 12 and the straw member 11 and arranged at an end away from the free end of the sippy spout member 12. The sippy spout assembly 1 may also be configured to include a straw member fixedly connected to the cup lid body and a sippy spout member rotatably connected to the cup lid body; when the sippy spout member is in the open state, a drinking channel in the sippy spout member is communicated with a drinking channel in the straw member; and when the sippy spout member is in the closed state, an outer wall of the sippy spout member blocks the drinking channel in the straw member. The sippy spout assembly 1 may also include a sippy spout lid rotatably connected to the sippy spout sleeve 13. In this case, the first locking portion 10 is arranged on the sippy spout lid, and the sippy spout assembly 1 can also be kept in the closed state by making the first locking portion 10 fitted with the second locking portion 20.

As shown in FIG. 6, in some specific examples, the handle structure 42 is arranged at a side portion of the lid structure 41 along a first direction A. The first locking portion 10 and the second locking portion 20 are capable of being locked as the transmission structure 2 moves along the first direction A, and unlocked as the transmission structure 2 moves along a second direction B opposite to the first direction A. The operating structure 3, when moving along an operating direction, drives the transmission structure 2 to move along the second direction B, thereby unlocking the first locking portion 10 and the second locking portion 20. Compared with the unlocking structure of manually flipping the sippy spout to slide over the locking groove directly in the prior art, in this example, the second locking portion 20 is unlocked from the first locking portion 10 by making the second locking portion move along the second direction B along with the transmission structure 2, which greatly reduces the friction produced between the second locking portion 20 and the first locking portion 10 in the unlocking process, prolongs the service life of the first locking portion 10 and the second locking portion 20 and makes the straw cup more durable and practical.

Figure 4:
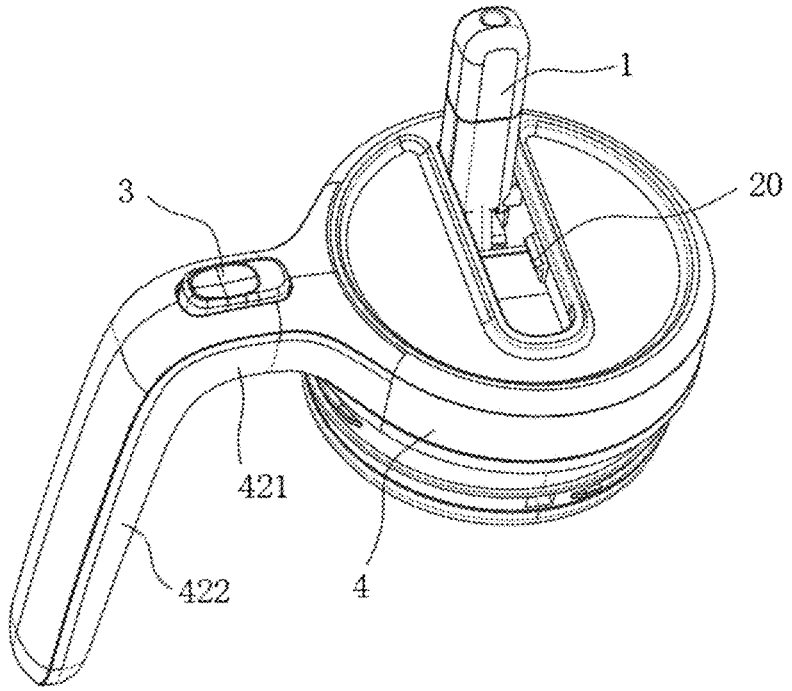
FIG. 4 is a schematic structural view of a cup lid according to an example of the disclosure.

As shown in FIG. 4 and FIG. 6, in some specific examples, the sippy spout assembly 1 and the lid structure 41 are rotatably connected by means of a first rotating shaft 14. The lid structure 41 includes a first pedestal 411 arranged therein. A first transmission channel 4111 runs through the first pedestal 411. The transmission structure 2 is slidable along the first transmission channel 4111 so as to move between the first locked position of being locked relative to the sippy spout assembly 1 and the first unlocked position of being unlocked relative to the sippy spout assembly 1. The transmission structure 2 is guided to slide along the first transmission channel 4111, which improves the stability of the movement of the transmission structure 2. In this example, the sippy spout sleeve 13 and the first pedestal 411 are rotatably connected by means of the first rotating shaft 14. The first rotating shaft 14 is formed by protruding outward from two sides of the sippy spout sleeve 13 respectively. A rotating shaft hole I is formed between the first pedestal 411 and the lid structure 41. The rotating shaft hole I is used for the mounting and rotation of the first rotating shaft 14. In other examples, the first rotating shaft 14 and the first pedestal 411 or the lid structure 41 are provided as an integral structure, and the rotating shaft hole I is arranged in the sippy spout sleeve 13. Alternatively, the first rotating shaft 14 may be provided as an independent structure, and the shaft hole I is provided in the sippy spout sleeve 13 and the first pedestal 411 or the lid structure 41. Alternatively, in other examples where the sippy spout sleeve 13 is not provided, the first rotating shaft 14 may also be arranged between the sippy spout member 11 and the first pedestal 411. Alternatively, in other examples where the first pedestal 411 is not provided, the first rotating shaft 14 may also be arranged between the sippy spout sleeve 13 and other structures on the lid structure 41. In all the above cases, the sippy spout assembly 1 and the lid structure 41 can be rotatably connected.

Figure 10:
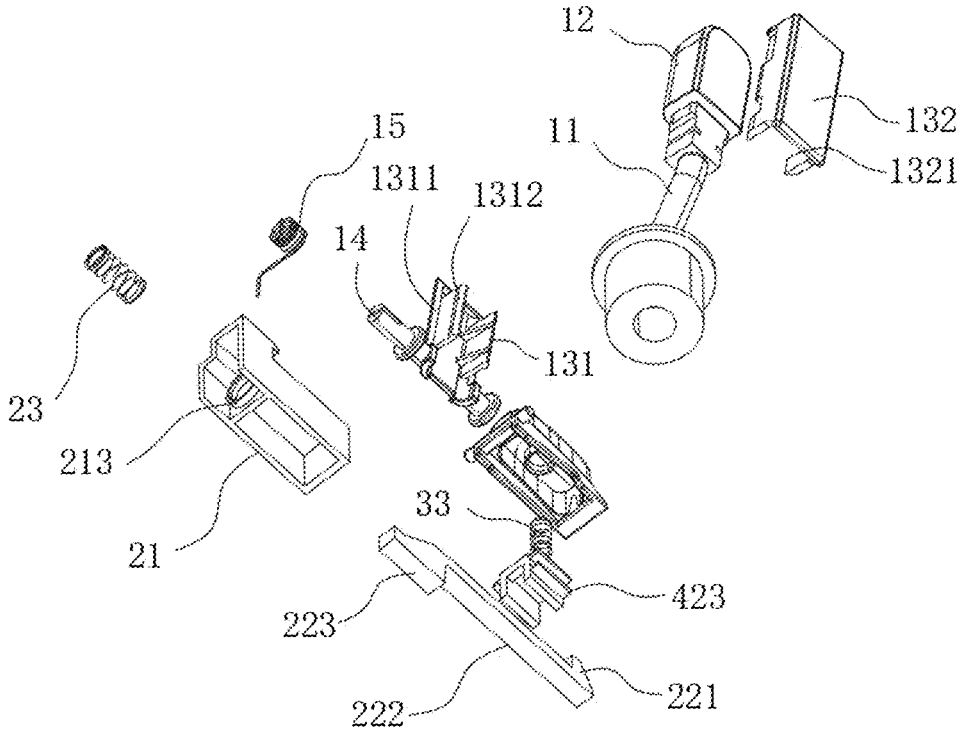
FIG. 10 is a schematic exploded structural view of the sippy spout assembly, the transmission structure and the operating structure according to an example of the disclosure.
Figure 11:
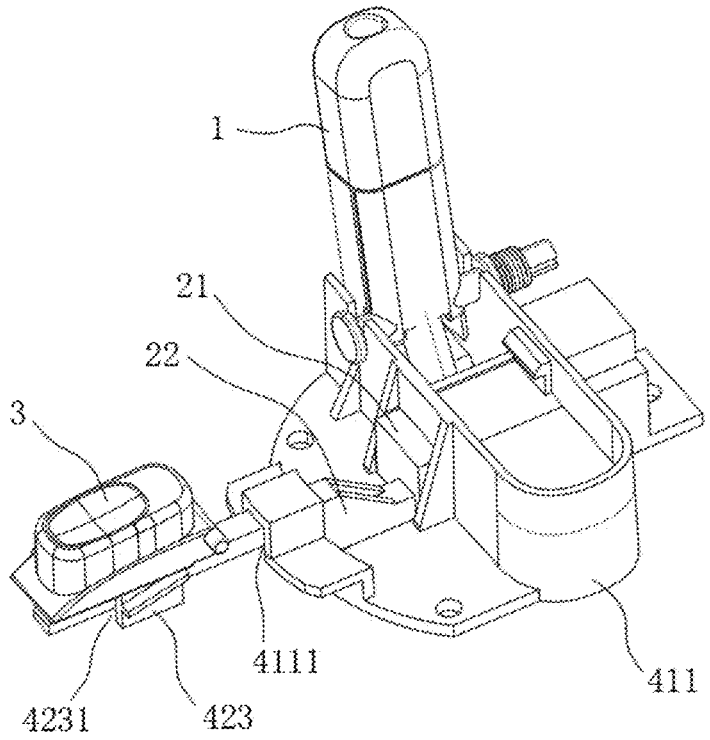
FIG. 11 is a schematic structural view I of the sippy spout assembly, the transmission structure, the operating structure, a first pedestal and a second pedestal according to an example of the disclosure.
Figure 12:
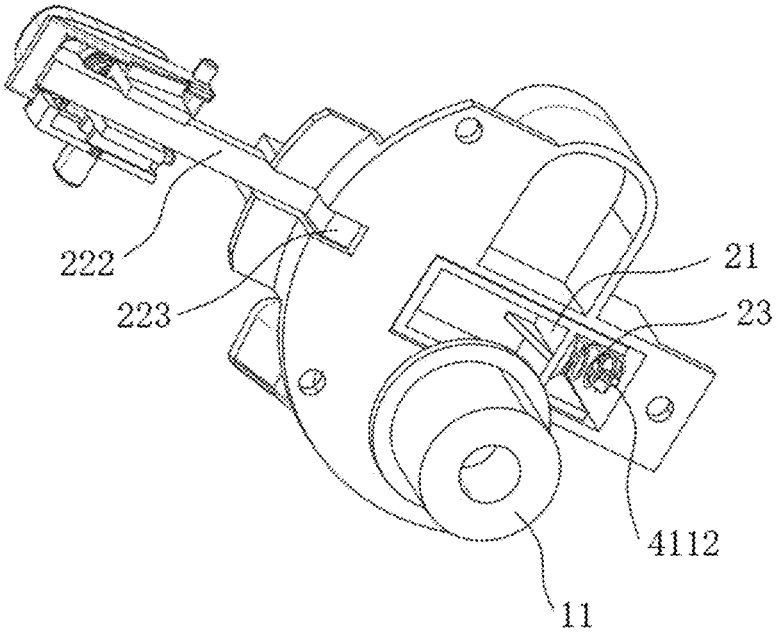
FIG. 12 is a schematic structural view II of the sippy spout assembly, the transmission structure, the operating structure, the first pedestal and the second pedestal according to an example of the disclosure.

As shown in FIG. 10, in some specific examples, the sippy spout sleeve 13 includes a sleeve shell I 131 and a sleeve shell II 132 detachably connected with the sleeve shell I 131. A sleeving channel is formed by the sleeve shell I 131 and the sleeve shell II 132. An end of the straw member 11 close to the sippy spout member 12 is sleeved in the sleeving channel. End surfaces at ends of the sleeve shell I 131 and the sleeve shell II 132 close to the sippy spout member 12 respectively abut against an end surface at an end of the sippy spout member 12 away from its free end. The first rotating shaft 14 protrudes from two sides of the sleeve shell I 131, and first rotating shaft 14 is arranged perpendicular to the sippy spout assembly 1. An inner side of the sleeve shell I 131 is convexly provided with two snap-fit fasteners I 1312 respectively arranged at two sides of the sleeving channel.

Inner sides of two side walls of the sleeve shell II 132 are respectively provided with snap-fit fasteners II 1321 corresponding to the two snap-fit fasteners I 1312. The sleeve shell I 131 and the sleeve shell II 132 are detachably connected by means of the snap fit between the snap-fit fasteners I 1312 and the snap-fit fasteners II 1321, which facilitates the assembly. An outer side wall of the sleeve shell II 132 away from the operating structure 3 I is recessed from an end surface close to the sleeve shell I 131 to form a notch, and the first locking surface 1311 is arranged at a top end surface of the sleeve shell I 131 away from a side wall of the operating structure 3. When the sleeve shell I 131 and the sleeve shell II 132 are connected, the notch and the first locking surface 1311 form the above recess structure, which is convenient for processing and molding. In other examples, the recess structure may also be formed by recessing from an outer side wall of the sleeve shell I 131 or the sleeve shell II 132.

As shown in FIG. 9, in some specific examples, a first return member 23 for driving the transmission structure 2 to be kept in the first locked position is mounted between the transmission structure 2 and the first pedestal 411, which is used for realizing automatic return of the transmission structure 2, so that when the operator flips the sippy spout assembly 1 to the closed position, the first locking portion 51 can be fitted with the second locking portion 52 in time by means of the first return member 23. The first rotating shaft 14 is provided with a third return member 15 for driving the sippy spout assembly 1 to be kept in the open state, so that when the operator drives the operating structure 3 to move so as to drive the transmission structure 2 move until the first locking portion 10 and the second locking portion 20 are unfitted, the sippy spout assembly 1 can be immediately driven to rotate from the closed state to the open state by means of the third return member 15. In this way, the sippy spout assembly 1 can be opened immediately after operation, so that the operator can quickly open the sippy spout assembly 1 and suck water, which makes the straw cup convenient and quick to use and especially suitable for use during driving. In other examples, there may be no third return member 15 provided, and the sippy spout assembly 1 may be driven to rotate from the closed state to the open state by means of elasticity of the straw member 11.

As shown in FIG. 7, in some specific examples, the first return member 23 is arranged between an end of the transmission structure 2 away from the operating structure 3 and an inner side wall of the first pedestal 411. The first return member 23 may be provided as a compression spring, elastic silicone or another structure. The end of the transmission structure 2 away from the operating structure 3 is convexly provided with a positioning platform III 213 configured to be positioned and connected with one end of the first return member 23. The inner side wall of the first pedestal 411 is convexly provided with a positioning platform VI 4112 configured to be positioned and connected with the other end of the first return member 23. The arrangement of the positioning platform III 213 and the positioning platform IV 4112 facilitates the positioning and assembly of the first return member 23.

Figure 13:
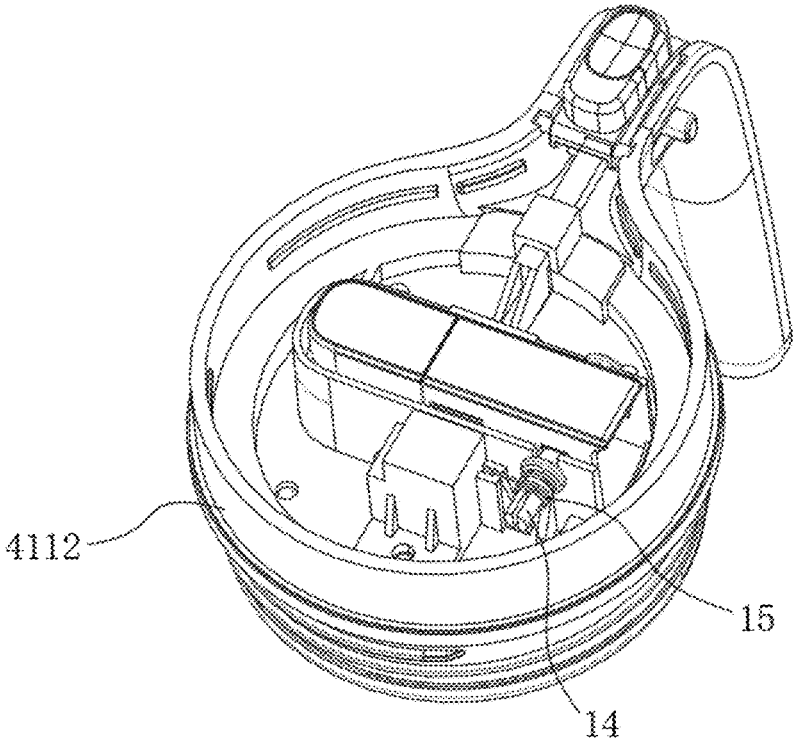
FIG. 13 is a schematic partial structural view I of the cup lid according to an example of the disclosure.
Figure 14:
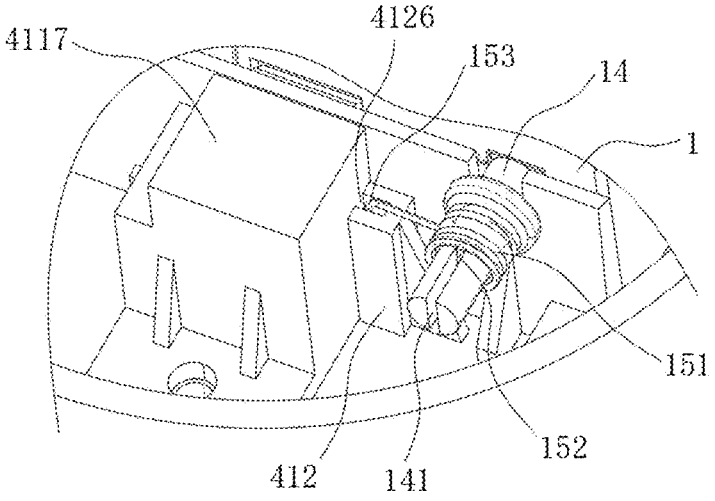
FIG. 14 is a schematic partial structural view II of the cup lid according to an example of the disclosure.

As shown in FIG. 13 and FIG. 14, in some specific examples, the third return member 15 is provided as a torsion spring, including a coil portion 151 sleeved outside the first rotating shaft 14, and a torsion arm portion I 152 and a torsion arm portion II 153 respectively extending out of two ends of the coil portion 151. The first rotating shaft 14 is provided with a torsion arm channel I 141, and a lid base 412 is provided with a torsion arm channel II 4126. The torsion arm portion I 152 runs through and is limited in the torsion arm channel I 141, and an end portion of the torsion arm portion II 153 runs through and is limited in the torsion arm channel II 4126. When the torsion arm portion I 152 rotates to the closed state along with the sippy spout assembly 1 to compress the third return member 15, the third return member 15 provides a reaction force and drives the sippy spout assembly 1 to rotate to the open state by means of the torsion arm portion I 152. In other examples, the torsion arm channel II 4126 may also be provided in the first pedestal 411. The third return member 15 may also be provided as a tension spring or another structure having a return function; or there may be no third return member 15 provided, and the sippy spout assembly 1 is driven to rotate from the closed state to the open state by means of the elasticity of the straw member 11.

Figure 5:
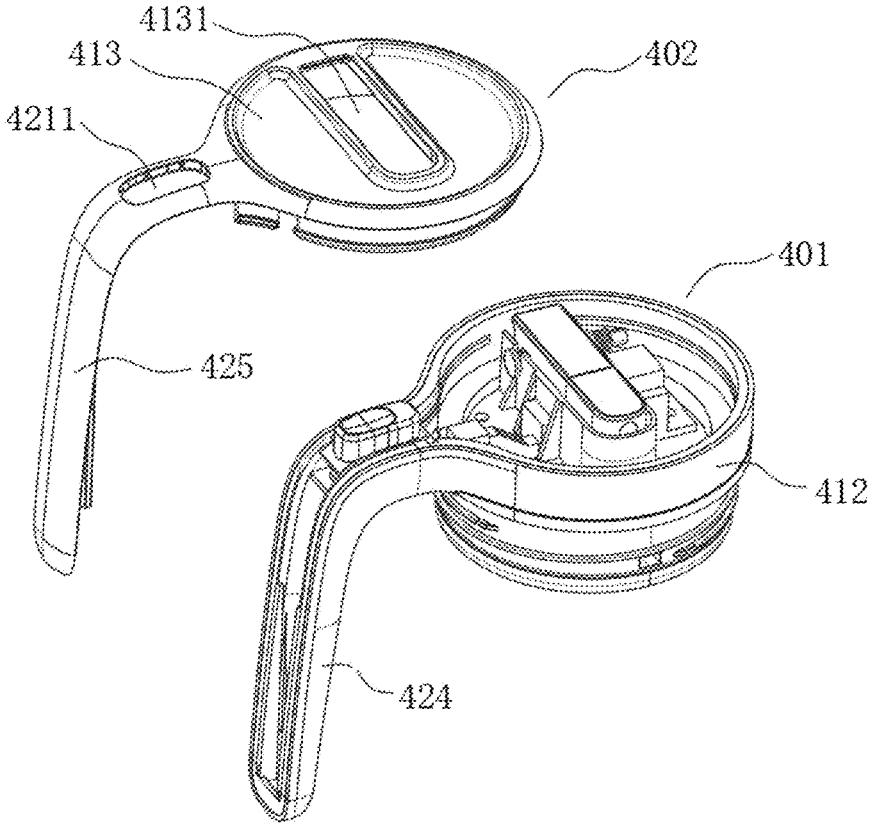
FIG. 5 is a schematic exploded structural view I of the cup lid according to an example of the disclosure.

As shown in FIG. 5, in some specific examples, the lid structure 41 includes a lid base 412 and a lid cover plate 413 connected with the lid base 412, and the handle structure 42 includes a handle base 424 and a handle cover plate 425 connected with the handle base 424. The lid base 412 and the handle base 424 are integrally molded to form a body base 401, and the lid cover plate 413 and the handle cover plate 425 are integrally molded to form a body cover plate 402. The body base 401 and the body cover plate 402 form a mounting chamber for mounting the first pedestal 411, the transmission structure 2 and the operating structure 3. By designing the body base 401 and body cover plate 402 to be integrally molded respectively, the structure is steady and firm. Moreover, the mounting chamber can be opened conveniently and quickly, which facilitates the assembly of the first pedestal 411, the transmission structure 2 and the operating structure 3, thereby improving the production efficiency.

Figure 15:
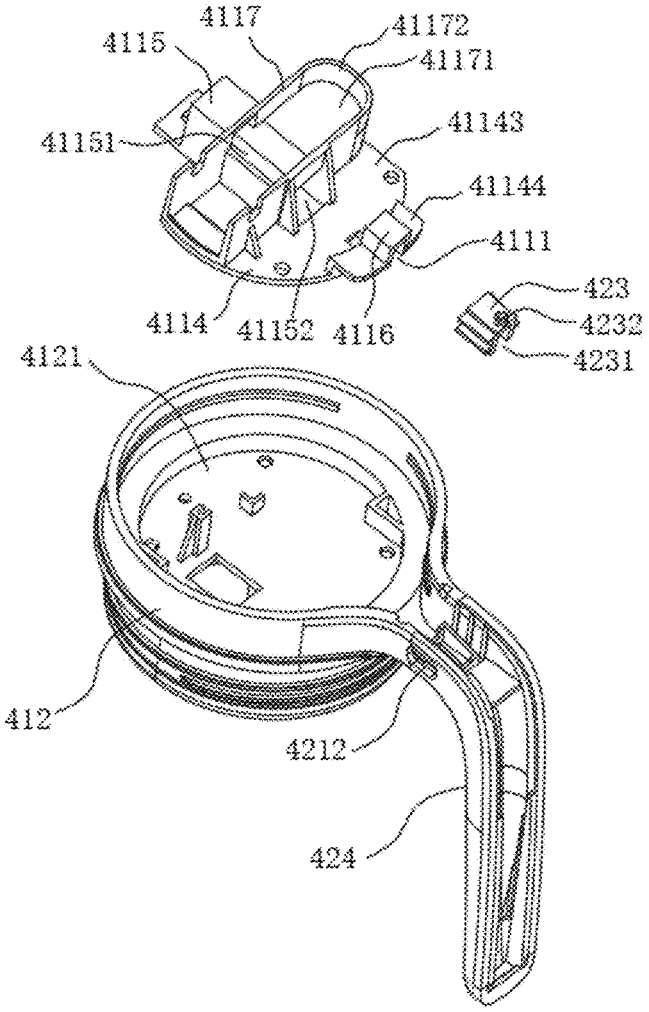
FIG. 15 is a schematic partial exploded structural view II of the cup lid according to an example of the disclosure.

As shown in FIG. 15, in some specific examples, the first pedestal 411 is arranged in the mounting chamber and detachably connected with the lid base 412. The first pedestal 411 includes a base plate I 4114, an enclosure plate I 4115 and an enclosure plate II 4116 respectively connected to an upper side of the base plate I 4114, and an enclosure plate III 4117 connected with the enclosure plate I 4115 and the base plate I 4114. The base plate I 4114 is horizontally arranged at a top surface of the lid base 412. The base plate I 4114 and the lid base 412 are respectively correspondingly provided with a plurality of fastening channels. The base plate I 4114 and the lid base 412 are fastened by making fasteners such as screws and bolts fitted in the corresponding fastening channels, which facilitates mounting or demounting. The transmission structure 2 includes a first transmission member 21 provided with the second locking portion 20, and a second transmission member 22 arranged between the first transmission member 21 and the operating structure 3. The first transmission member 21 and the second transmission member 22 are respectively provided as an independent structure. The enclosure plate I 4115 has a third transmission channel 41151 therein for accommodating the first transmission member 21 and for the first transmission member 21 to slide therein along the first direction A or the second direction B. The base plate I 4114 is provided with a first opening 41141 for mounting and demounting the first transmission member 21. A side of the enclosure plate I 4115 close to the operating structure 3 is provided with a third opening 41152 for the first transmission member 21 or the second transmission member 22 to run through. The enclosure plate II 4116 has the first transmission channel 4111 therein for accommodating the second transmission member 22 and for the second transmission member 22 to slide therein along the first direction A or the second direction B. The base plate I 4114 is provided with a second opening 41142 for mounting and demounting the second transmission member 22. The enclosure plate I 4115 and the enclosure plate II 4116 are respectively arranged at an upper side of the base plate I 4114. The first opening 41141 is communicated with the third transmission channel 41151, and the second opening 41142 is communicated with the first transmission channel 4111, which facilitates the mounting or demounting of the first transmission member 21 and the second transmission member 22. The third opening 41152 is communicated with the third transmission channel 41151, which provides a butting channel for the first transmission member 21 to abut against the second transmission member 22. This structure is simple and ingenious in design and convenient for production and assembly. In other examples, the first transmission member 21 and the second transmission member 22 may also be integrally molded, so as to provide structural stability. In this example, the enclosure plate III 4117 is connected to both the enclosure plate I 4115 and the base plate I 4114, which is firmer in connection. In other examples, the enclosure plate III 4117 may also be connected with either the enclosure plate I 4115 or the base plate I 4114 only.

Figure 16:
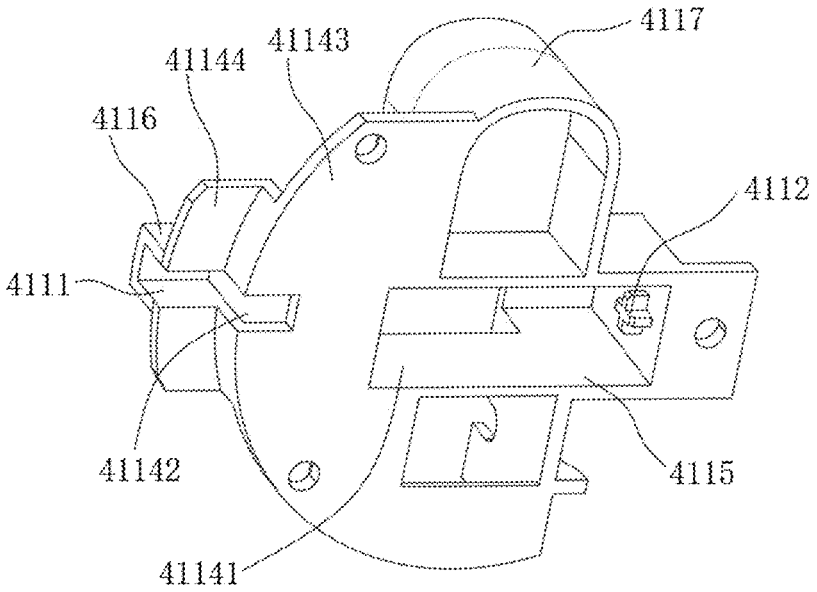
FIG. 16 is a schematic structural view of the first pedestal according to an example of the disclosure.

As shown in FIG. 15 and FIG. 16, in some specific examples, a top of the lid base 412 is concavely provided with a sinking groove 4121. The base plate I 4114 includes a plate portion I 41143 arranged in the sinking groove 4121 and a plate portion II 41144 arranged at a top of a side wall of the sinking groove 4121. A shape of the base plate I 4114 is matched with that of the sinking groove 4121, which is beneficial to the stable connection between the base plate I 4114 and the lid base 412. The enclosure plate I 4115 and the enclosure plate III 4117 are connected to the plate portion I 41143. The enclosure plate II 4116 is connected to the plate portion II 41144. The plate portion II 41144 is connected to a side of the plate portion I 41143 close to the handle structure 42, which is convenient for the arrangement of the second transmission member 22. The second transmission member 22 includes a transmission rod I 222 slidably connected in the first transmission channel 4111 and a transmission rod II 223 connected to an end of the transmission rod I 222 close to the sippy spout assembly 1. The transmission rod II 223 is arranged in the sinking groove 4121. When the transmission structure 2 moves to the first locked position close to the operating structure 3, the transmission rod II 223 abuts against a side wall of the sinking groove 4121 so as to be limited. The second opening 41142 is provided as an L-shaped hole structure provided in both the plate portion I 41143 and the plate portion II 41144, which provides a movement channel for the transmission rod II 223 to run through the base plate I 4114 and abut against the side wall of the sinking groove 4121.

In some specific examples, the enclosure plate III 4117 has an accommodating groove 41171 therein for accommodating the sippy spout assembly 1. The accommodating groove 41171 is communicated with the third transmission channel 41151. The accommodating groove 41171 is arranged perpendicular to the third transmission channel 41151. The third transmission channel 41151 includes a channel I arranged below the accommodating groove 41171 and a channel II arranged at a side of the accommodating groove 41171 away from the operating structure 3. The first transmission member 21 is arranged in the channel I, and the second connecting block 212 is arranged in the channel II. The second connecting block 212 is connected to an upper side of the first transmission member 21 at an end away from the operating structure 3. The second locking portion 20 is capable of moving with the second connecting block 212 and the first transmission member 21 under the elasticity of the first return member 23 to extend into the accommodating groove 41171 along the first direction A and form a snap fit with the first locking portion 10 on the sippy spout assembly 1, and returning, when the operator presses the operating structure 3, into the channel II accommodated at the side portion of the accommodating groove 41171 as the second connecting block 212 and the first transmission member 21 move along the second direction B. A top of the enclosure plate III 4117 and the lid cover plate 413 are respectively correspondingly provided with a flip channel 41172 for the sippy spout assembly 1 to switch between the open state and the closed state. The lid cover plate 413 is provided with a fifth opening 4131 provided corresponding to the flip channel 41172. The base plate I 4114 and the lid base 412 are respectively correspondingly provided with a fourth opening for the straw member 11 of the sippy spout assembly 1 to run out of the body base 401. The first direction A is arranged along a radial direction of the lid base 412. The fourth opening is provided at an outer side of the enclosure plate I 4115. The fourth opening in the base plate I 4114 is communicated with the accommodating groove 41171, which facilitates the arrangement and assembly of the straw member 11.

As shown in FIG. 4, in some specific examples, the handle structure 42 includes a handle connecting portion 421 connected to the side portion of the lid structure 41 along the first direction A, and a handle holding portion 422 connected with the handle connecting portion 421, and the operating structure 3 is arranged on the handle connecting portion 421, which conforms to the human body structure and is convenient for holding the handle connecting portion 421 while pressing the operating structure 3. In other examples, the operating structure 3 may also be arranged on the handle holding portion 422. The operating structure 3 includes an operating portion 31 and a first transmission portion 32 connected to the operating portion 31. The handle connecting portion 421 is provided with an operating channel 4211 arranged corresponding to the operating portion 31. The transmission structure 2 includes a second transmission portion 221 arranged at a side of the first transmission portion 32 close to the sippy spout assembly 1. The second transmission portion 221 is connected to an end of the transmission rod I 222 close to the operating structure 3. An arrangement direction of the second transmission portion 221 forms an acute angle with the second direction B. That is, a vertical distance between the second transmission portion 221 and the sippy spout assembly 1 gradually decreases from the end away from the operating structure 3 to the end close to the operating structure 3. The operating direction of the operating structure 3, the second direction B and the arrangement direction of the second transmission portion 221 are not parallel with each other. When the operator applies force to the operating portion 31 along the operating direction, the transmission structure 2 is pushed to move along the second direction B to unlock the first locking portion 10 and the second locking portion 20 by making the first transmission portion 32 abut against the second transmission portion 221 and move along a surface of the second transmission portion 221. In this example, since the operating direction of the operating structure 3 is different from the movement direction of the transmission structure 2, the operating direction may be set to an angle and direction suitable for the human hand to press, so that the operator can press the operating structure 3 conveniently. In other examples, the movement direction of the operating structure 3 may be set to be the same as the movement direction of the transmission structure 2, so that when the operator presses the operating structure 3 along the operating direction, the first locking portion 10 and the second locking portion 20 can be unfitted by making the first transmission portion 32 abut against the second transmission portion 211 and further pushing the transmission structure 2 to move close to the sippy spout assembly 1.

Figure 19:
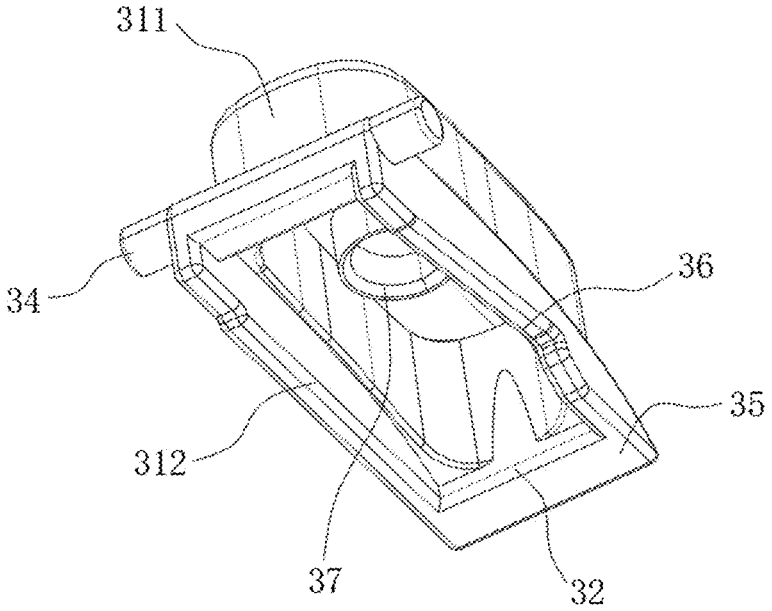
FIG. 19 is a schematic structural view of the operating structure according to an example of the disclosure.

As shown in FIG. 19, in some specific examples, the operating portion 31 and the handle connecting portion 421 are rotatably connected by means of a second rotating shaft 34. The operating direction is arranged along a circumferential direction of the second rotating shaft 34. The second rotating shaft 34 is arranged at an end of the operating portion 31 close to the sippy spout assembly 1, and the first transmission portion 32 is arranged at an end of the operating portion 31 away from the sippy spout assembly 1. When the operator presses the operating structure 3 along the operating direction to rotate along the circumferential direction of the second rotating shaft 34, the first transmission portion 32 rotates along the circumferential direction of the second rotating shaft 34 along with the operating structure 3, and at the same time, the first transmission portion 32 abuts against the second transmission portion 221 and moves along the surface of the second transmission portion 221 toward an end of the second transmission portion 221 away from the sippy spout assembly 1, so as to push the transmission structure 2 to move along the second direction B until the first locking portion 10 and the second locking portion 20 are unfitted. According to the lever principle, the second rotating shaft 34 is arranged at the end of the operating portion 31 close to the sippy spout assembly 1, so that the operating structure 3 is mounted onto the handle connecting portion 421 by means of the second rotating shaft 34, which is easier and more labor-saving to use. In other examples, the second rotating shaft 34 may also be arranged at a middle part of the operating portion 31. As another example of the disclosure, there may be no second rotating shaft 34 provided. Instead, the operating portion 31 is retractably connected in the operating channel 4211, and the operating direction is arranged along the extension and retraction direction, which can also be used for mounting the operating structure 3.

As shown in FIG. 7 and FIG. 15, in some specific examples, the handle structure 42 includes a second pedestal 423 arranged therein. A second transmission channel 4231 runs through the second pedestal 423. The transmission structure 2 is slidable along the second transmission channel 4231 so as to move between the first locked position of being locked relative to the sippy spout assembly 1 and the first unlocked position of being unlocked relative to the sippy spout assembly 1. Moreover, the transmission structure 2 is guided to slide along the first transmission channel 4111 and the second transmission channel 4231, which further improves the stability of the movement of the transmission structure 2. A second return member 33 for driving the operating structure 3 to return after moving along the operating direction is mounted between an inner wall of the operating structure 3 and the second pedestal 423, which is used for realizing automatic return of the operating structure 3 and making preparations for the next press operation. The second return member 33 may be provided as a compression spring, or elastic silicone or another structure arranged between the inner wall of the operating portion 31 and the second pedestal 423. The inner wall of the operating portion 31 is convexly provided with a positioning platform I 37 configured to be positioned and connected with one end of the second return member 33, and an outer wall of the second pedestal 423 is convexly provided with a positioning platform II 4232 configured to be positioned and connected with the other end of the second return member 33. The arrangement of the positioning platform I 37 and the positioning platform II 4232 facilitates the positioning and assembly of the second return member 33.

Figure 2:
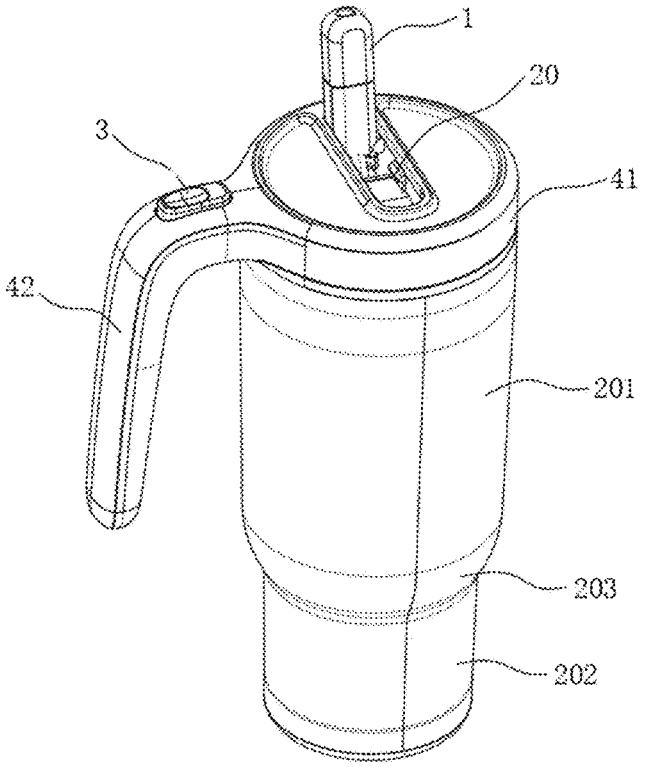
FIG. 2 is a schematic structural view II of the straw cup according to an example of the disclosure.

As shown in FIG. 2, in some specific examples, the cup body 200 includes a first cup body structure 201, a second cup body structure 202 and a third cup body structure 203 connected between a lower end of the first cup body structure 201 and an upper end of the second cup body structure 202. The second cup body structure 202 has an outer diameter less than that of the first cup body structure 201 so as to be positioned and connected with an external placement medium, such as a vehicle-mounted water cup placement groove, which improves the stability of the placement of the straw cup. The cup lid 100 is detachably connected to an upper end of the first cup body structure 201. A free end of the handle structure 42 is arranged toward the lower end of the first cup body structure 201. An arrangement height of a lower end of the handle structure 42 is greater than an arrangement height of an upper end of the first cup body structure 201, or the arrangement height of the lower end of the handle structure 42 is greater than an arrangement height of an upper end of the third cup body structure 203, which avoids interfering with the positioning of the straw cup on the external placement medium.

Figure 3:
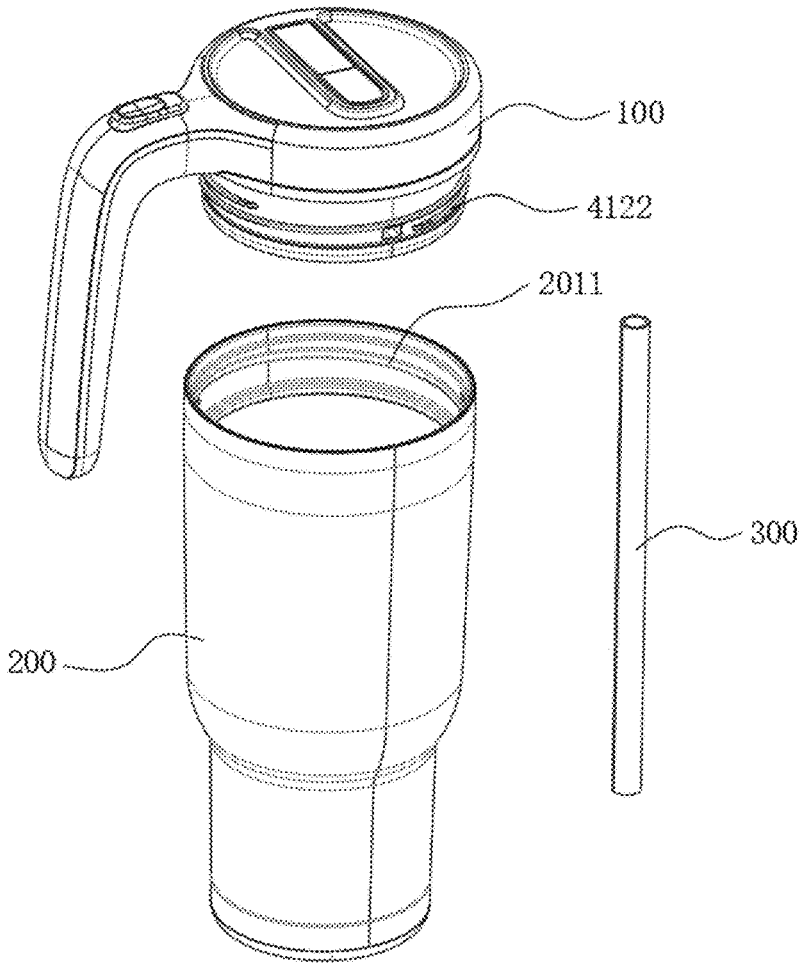
FIG. 3 is a schematic exploded structural view of the straw cup according to an example of the disclosure.

As shown in FIG. 3, in some specific examples, a tube member 300 is arranged in the cup body 200. The tube member 300 is butted with a lower end of the straw member 11 of the sippy spout assembly 1, and configured to introduce the liquid in the cup body 200 into the sippy spout assembly 1. An outer peripheral side of a lower part of the lid base 412 is provided with an external thread structure 4122, and an inner peripheral side of the upper end of the first cup body structure 201 is provided with an internal thread structure 2011. The cup lid 100 and the cup body 200 form a thread fit by means of the external thread structure 4122 the internal thread structure 2011, which is stable in connection, convenient to mount and demount and also convenient to clean. A bottom of the lid base 412 is provided with a first pressure relief channel 4123 arranged in vertical direction, and a side wall of the lower part of the lid base 412 is provided with a second pressure relief channel 4124 communicated with the first pressure relief channel 4123. The first pressure relief channel 4123 is provided with a one-way valve 4125. When the operator sucks the sippy spout assembly 1, a negative pressure is formed in the cup body 200, and the one-way valve 4125 opens the first pressure relief channel 4123 under the action of the negative pressure, thereby allowing outside air to enter the cup body 200 and making the operator suck water easily. When the operator stops sucking, the one-way valve 4125 closes the first pressure relief channel 4123, thereby avoiding water leakage.

Figure 17:
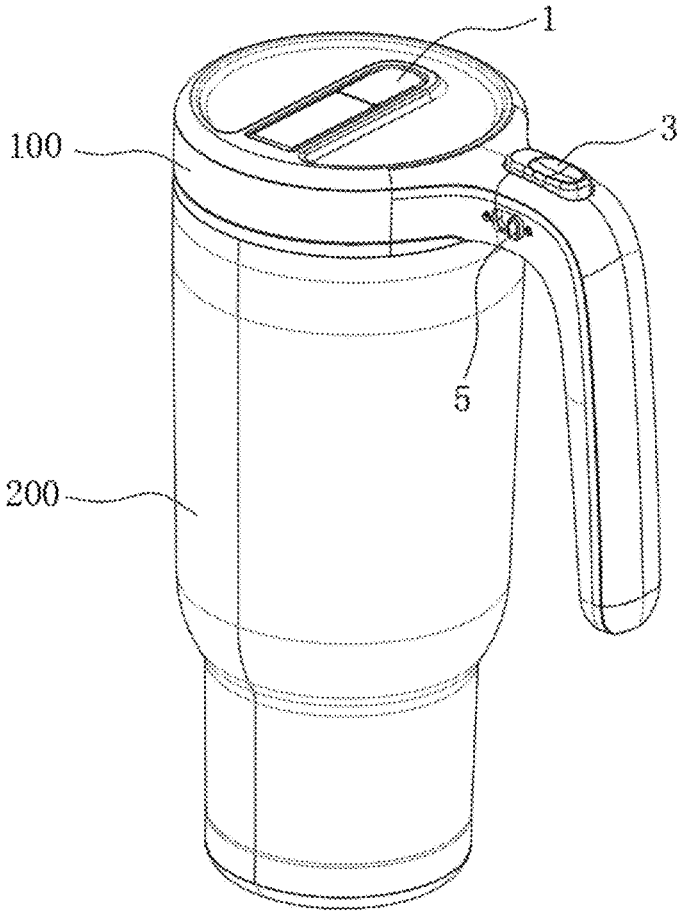
FIG. 17 is a schematic partial structural view III of the straw cup according to an example of the disclosure.
Figure 18:
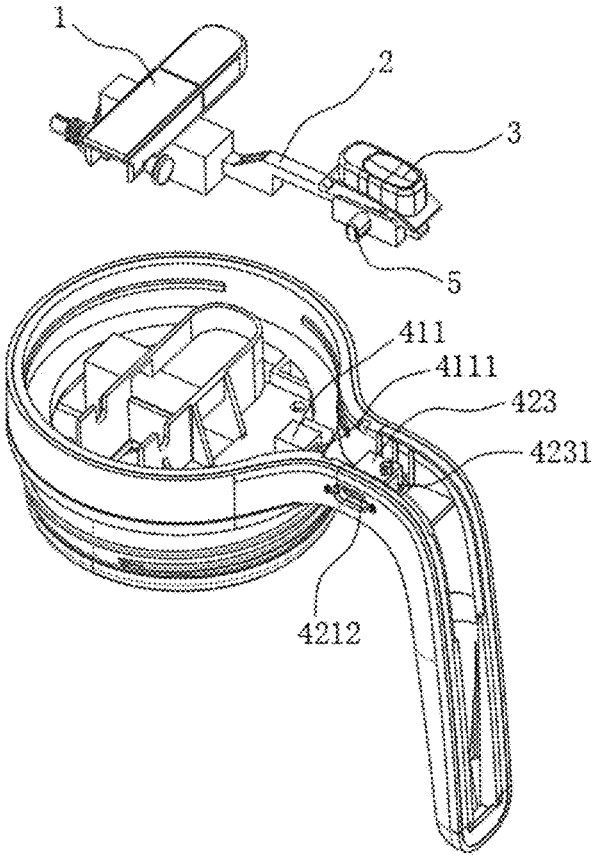
FIG. 18 is a schematic partial exploded structural view of the cup lid according to an example of the disclosure.

As shown in FIG. 17 to FIG. 18, in some specific examples, the straw cup further includes a second locking structure 5. The second locking structure 5 is mounted on the handle structure 42 and arranged corresponding to the operating structure 3, and the second locking structure 5 is capable of switching between a second locked position of preventing the operating structure 3 from moving toward the operating direction and a second unlocked position of allowing the operating structure 3 to move toward the operating direction, which prevents the sippy spout assembly 1 from being opened by accidental pressing when the straw cup is not in use, and improves the safety. The second locking structure 5 is arranged on the handle connecting portion 421, which conforms to the human body structure, so that the second locking structure 5 can be operated to switch between the second locked position and the second unlocked position while the handle connecting portion 421 is held.

Figure 20:
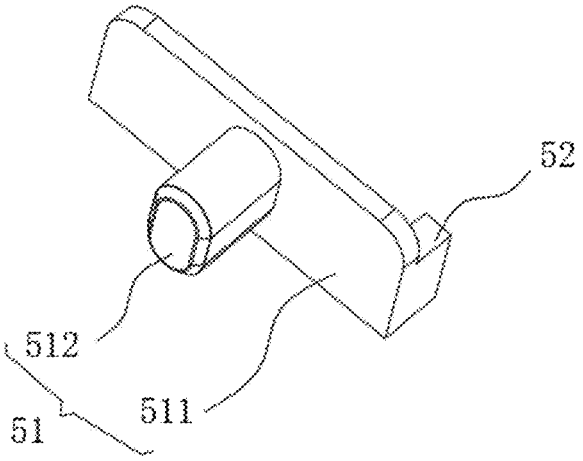
FIG. 20 is a schematic structural view of a second locking structure according to an example of the disclosure.

As shown in FIG. 19 and FIG. 20, in some specific examples, a side of the operating structure 3 close to the transmission structure 2 is provided with a third locking portion 35 and an unlocking groove 36 arranged adjacent to each other, and the positioning platform I 37 is arranged in the unlocking groove 36. The second locking structure 5 includes a locking operating portion 51 slidably connected to the handle structure 42 and a fourth locking portion 52 connected to an inner side of the locking operating portion 51. When the second locking structure 5 is in the second locked position, the operating structure 3 is prevented from moving toward a press operation direction by making the fourth locking portion 52 abut against the third locking portion 35, which can avoid opening the sippy spout assembly 1 by accidentally pressing the operating structure 3. When the second locking structure 5 is switched to the second unlocked position, the operating structure 3 is allowed to move toward the press operation direction by making the fourth locking portion 52 accommodated in the unlocking groove 36, and thereby, the operating structure 3 can move toward the operating direction to open the sippy spout assembly 1. The locking operating portion 51 includes a locking operating plate 511 arranged between the inner wall of the handle structure 42 and the second pedestal 423, and a locking operating button 512 convexly provided at an outer side of the locking operating plate 511. The fourth locking portion 52 is convexly provided at an inner side of the locking operating plate 511. The handle structure 42 is provided with a locking channel 4212 arranged along the first direction A. The locking operating button 512 runs through the locking channel 4212 and out of the outer side of the handle structure 42 such that the operator can contact and apply force on it. When the second locking structure 5 switches between the second locked position and the second unlocked position, the locking operating button 512 is guided to slide along a length direction of the locking channel 4212. In addition, in this example, the operating portion 31 includes an operating body 311 and an operating base plate 312 connected to an inner end of the operating body 311. The operating body 311 is arranged in the operating channel 4211, and is movable relative to the operating channel 4211 when moving along the operating direction. The operating base plate 312 is arranged at an inner side of the operating channel 4211, and is capable of abutting against the inner wall of the handle structure 42 so as to be limited, which prevents the operating structure 3 from coming out of the handle structure 42. The second rotating shaft 34 is formed by protruding outward from two sides at an end of the operating base plate 312 close to the sippy spout assembly 1 respectively. The handle structure 42 is provided with a rotating shaft hole II. The rotating shaft hole II is used for the mounting and rotation of the second rotating shaft 34, such that the operating structure 3 and the handle structure 42 can be rotatably connected. The third locking portion 35 is arranged at an end of the operating base plate 312 away from the sippy spout assembly 1, and provided as a partial structure of the operating base plate 312, which simplifies the structure.

In summary, the above description is only a preferred embodiment of the present invention, and any equivalent changes and modifications made within the scope of the present invention patent application should be within the scope of the present invention patent.

What is claimed is:

1. A straw cup, comprising a cup body and a cup lid covering the cup body, wherein the cup lid comprises:

a cup lid body, comprising a lid structure and a handle structure connected to the lid structure;

a sippy spout assembly, rotatably connected to the lid structure and having a closed state of being folded relative to the lid structure and an open state of being unfolded relative to the lid structure, the sippy spout assembly being provided with a first locking portion;

a transmission structure, provided with a second locking portion arranged corresponding to the first locking portion, the sippy spout assembly being kept in the closed state by making the first locking portion fitted with the second locking portion, and the sippy spout assembly being allowed to switch to the open state by unfitting the first locking portion and the second locking portion; and an operating structure, mounted on the handle structure, connected with the transmission structure in a transmission way, and capable of moving relative to the handle structure to drive the transmission structure to move until the second locking portion is away and unfitted from the first locking portion.

2. The straw cup according to claim 1, wherein the first locking portion has a first locking surface, and the second locking portion has a second locking surface; and the first locking portion and the second locking portion are fitted by making the second locking surface abut against an upper side of the first locking surface, and unfitted by making the second locking surface separated from the first locking surface.

3. The straw cup according to according to claim 2, wherein the first locking portion is arranged at a lower side of the sippy spout assembly or at a side of the sippy spout assembly away from the operating structure, and the transmission structure moves between a first locked position close to the operating structure and a first unlocked position close to the sippy spout assembly; when the transmission structure is in the first locked position and the sippy spout assembly is in the closed state, the second locking surface abuts against the upper side of the first locking surface; and when the transmission structure is in the first unlocked position and the sippy spout assembly is in the open state, the second locking surface is separated from the first locking surface and arranged at a side of the first locking surface away from the operating structure.

4. The straw cup according to claim 3, wherein the second locking portion comprises a second connecting block arranged along a height direction and a second locking block connected to an upper end of the second connecting block, and the second locking block protrudes from a side of the second connecting block close to the operating structure so as to form the second locking surface at a bottom surface of the second locking block.

5. The straw cup according to claim 4, wherein an arrangement direction of the transmission structure is perpendicular to an arrangement direction of the sippy spout assembly; the sippy spout assembly comprises a straw member, a sippy spout member connected to a free end of the straw member, and a sippy spout sleeve sleeved outside the straw member and/or the sippy spout member and arranged close to an end of the sippy spout member away from a free end of the sippy spout member; the first locking portion is provided as a recess structure recessed from a side of the sippy spout sleeve away from the operating structure; and a bottom surface of the recess structure forms the first locking surface.

6. The straw cup according to claim 5, wherein the handle structure is arranged at a side portion of the lid structure along a first direction; the first locking portion and the second locking portion are capable of being locked as the transmission structure moves along the first direction, and unlocked as the transmission structure moves along a second direction opposite to the first direction; and the operating structure, when moving along an operating direction, drives the transmission structure to move along the second direction.

7. The straw cup according to according to claim 6, wherein the sippy spout assembly and the lid structure are rotatably connected by means of a first rotating shaft; the lid structure comprises a first pedestal arranged therein; a first transmission channel runs through the first pedestal; the transmission structure is slidable along the first transmission channel so as to move between the first locked position of be locked relative to the sippy spout assembly and the first unlocked position of being unlocked relative to the sippy spout assembly; a first return member for driving the transmission structure to be kept in the first locked position is mounted between the transmission structure and the first pedestal or between the transmission structure and an inner wall of the lid structure; and the first rotating shaft is provided with a third return member for driving the sippy spout assembly to be kept in the open state.

8. The straw cup according to claim 7, wherein the lid structure comprises a lid base and a lid cover plate connected with the lid base, and the handle structure comprises a handle base and a handle cover plate connected with the handle base; the lid base and the handle base are integrally molded to form a body base, and the lid cover plate and the handle cover plate are integrally molded to form a body cover plate; and the body base and the body cover plate form a mounting chamber for mounting the first pedestal, the transmission structure and the operating structure.

9. The straw cup according to according to claim 8, wherein the first pedestal is arranged in the mounting chamber and detachably connected with the lid base; the first pedestal comprises a base plate I, an enclosure plate I and an enclosure plate II respectively connected to an upper side of the base plate I, and an enclosure plate III connected with the enclosure plate I and/or the base plate I; and the transmission structure comprises a first transmission member provided with the second locking portion, and a second transmission member arranged between the first transmission member and the operating structure.

10. The straw cup according to claim 9, wherein the enclosure plate I has a third transmission channel therein for accommodating the first transmission member and for the first transmission member to slide therein along the first direction or the second direction; the base plate I is provided with a first opening for mounting and demounting the first transmission member; a side of the enclosure plate I close to the operating structure is provided with a third opening for the first transmission member or the second transmission member to run through; and the enclosure plate II has the first transmission channel therein for accommodating the second transmission member and for the second transmission member to slide therein along the first direction or the second direction; and the base plate I is provided with a second opening for mounting and demounting the second transmission member.

11. The straw cup according to claim 10, wherein the enclosure plate III has an accommodating groove therein for accommodating the sippy spout assembly; the accommodating groove is communicated with the third transmission channel; the second locking portion is capable of moving with the first transmission member to extend into the accommodating groove and form a snap fit with the first locking portion on the sippy spout assembly; a top of the enclosure plate III and the lid cover plate are respectively correspondingly provided with a flip channel for the sippy spout assembly to switch between the open state and the closed state; and the base plate I and the lid base are respectively correspondingly provided with a fourth opening for the straw member of the sippy spout assembly to run out of the body base.

12. The straw cup according to claim 7, wherein the handle structure comprises a handle connecting portion connected to the side portion of the lid structure along the first direction, and a handle holding portion connected with the handle connecting portion; the operating structure is arranged on the handle connecting portion; the operating structure comprises an operating portion and a first transmission portion connected to the operating portion; the handle connecting portion is provided with an operating channel arranged corresponding to the operating portion; the transmission structure comprises a second transmission portion arranged at a side of the first transmission portion close to the sippy spout assembly; an arrangement direction of the second transmission portion forms an acute angle with the second direction; the operating direction of the operating structure, the second direction and the arrangement direction of the second transmission portion are not parallel with each other; and when an operator applies force to the operating portion along the operating direction, the transmission structure is pushed to move along the second direction to unlock the first locking portion and the second locking portion by making the first transmission portion abut against the second transmission portion and move along a surface of the second transmission portion.

13. The straw cup according to claim 12, wherein the operating portion and the handle connecting portion are rotatably connected by means of a second rotating shaft; the operating direction is arranged along a circumferential direction of the second rotating shaft; the second rotating shaft is arranged at a middle part of the operating portion or at an end of the operating portion close to the sippy spout assembly; the first transmission portion is arranged at an end of the operating portion away from the sippy spout assembly; and the handle structure comprises a second pedestal arranged therein; a second transmission channel runs through the second pedestal; the transmission structure is slidable along the second transmission channel so as to move between the first locked position of being locked relative to the sippy spout assembly and the first unlocked position of being unlocked relative to the sippy spout assembly; and a second return member for driving the operating structure to return after moving along the operating direction is mounted between an inner wall of the operating structure and the second pedestal.

14. The straw cup according to claim 3, wherein the handle structure is arranged at a side portion of the lid structure along a first direction; the first locking portion and the second locking portion are capable of being locked as the transmission structure moves along the first direction, and unlocked as the transmission structure moves along a second direction opposite to the first direction; and the operating structure, when moving along an operating direction, drives the transmission structure to move along the second direction.

15. The straw cup according to according to claim 14, wherein the sippy spout assembly and the lid structure are rotatably connected by means of a first rotating shaft; the lid structure comprises a first pedestal arranged therein; a first transmission channel runs through the first pedestal; the transmission structure is slidable along the first transmission channel so as to move between the first locked position of be locked relative to the sippy spout assembly and the first unlocked position of being unlocked relative to the sippy spout assembly; a first return member for driving the transmission structure to be kept in the first locked position is mounted between the transmission structure and the first pedestal or between the transmission structure and an inner wall of the lid structure; and the first rotating shaft is provided with a third return member for driving the sippy spout assembly to be kept in the open state.

16. The straw cup according to claim 1, wherein the handle structure is arranged at a side portion of the lid structure along a first direction; the first locking portion and the second locking portion are capable of being locked as the transmission structure moves along the first direction, and unlocked as the transmission structure moves along a second direction opposite to the first direction; and the operating structure, when moving along an operating direction, drives the transmission structure to move along the second direction.

17. The straw cup according to according to claim 16, wherein the sippy spout assembly and the lid structure are rotatably connected by means of a first rotating shaft; the lid structure comprises a first pedestal arranged therein; a first transmission channel runs through the first pedestal; the transmission structure is slidable along the first transmission channel so as to move between the first locked position of be locked relative to the sippy spout assembly and the first unlocked position of being unlocked relative to the sippy spout assembly; a first return member for driving the transmission structure to be kept in the first locked position is mounted between the transmission structure and the first pedestal or between the transmission structure and an inner wall of the lid structure; and the first rotating shaft is provided with a third return member for driving the sippy spout assembly to be kept in the open state.

18. The straw cup according to claim 1, wherein the cup body comprises a first cup body structure, a second cup body structure and a third cup body structure connected between a lower end of the first cup body structure and an upper end of the second cup body structure; the second cup body structure has an outer diameter less than that of the first cup body structure so as to be positioned and connected with an external placement medium; the cup lid is detachably connected to an upper end of the first cup body structure; a free end of the handle structure is arranged toward the lower end of the first cup body structure; and an arrangement height of a lower end of the handle structure is greater than an arrangement height of an upper end of the first cup body structure or the third cup body structure.

19. The straw cup according to claim 1, further comprising a second locking structure, wherein the second locking structure is mounted on the handle structure and arranged corresponding to the operating structure, and the second locking structure is capable of switching between a second locked position of preventing the operating structure from moving toward the operating direction and a second unlocked position of allowing the operating structure to move toward the operating direction.

20. The straw cup according to claim 19, wherein a side of the operating structure close to the transmission structure is provided with a third locking portion and an unlocking groove arranged adjacent to each other; the second locking structure comprises a locking operating portion slidably connected to the handle structure and a fourth locking portion connected to an inner side of the locking operating portion; when the second locking structure is in the second locked position, the operating structure is prevented from moving toward a press operation direction by making the fourth locking portion abut against the third locking portion; and when the second locking structure is switched to the second unlocked position, the operating structure is allowed to move toward the press operation direction by making the fourth locking portion accommodated in the unlocking groove.

* * * * *